United States Patent [19]

Oppitz

[11] Patent Number: 4,518,851

[45] Date of Patent: May 21, 1985

[54] PLANAR HEATING ELEMENT

[75] Inventor: Hans Oppitz, Mils, Austria

[73] Assignee: Eltac Nogler & Daum KG, Innsbruck, Austria

[21] Appl. No.: 549,613

[22] Filed: Nov. 7, 1983

[30] Foreign Application Priority Data

Nov. 11, 1982 [AT] Austria ..... 4094/82

[51] Int. Cl.[3] ..... H05B 3/38

[52] U.S. Cl. ..... 219/549; 219/528; 219/541; 219/543; 219/553; 338/22 SD; 338/212

[58] Field of Search ..... 219/211, 212, 528, 545, 219/549, 553, 541, 543, 548; 156/86; 338/22 R, 22 SD, 212; 29/611

[56] References Cited

U.S. PATENT DOCUMENTS

| | | | |
|---|---|---|---|
| 2,503,457 | 4/1950 | Speir et al. | 219/528 |
| 2,575,987 | 11/1951 | York et al. | 219/528 |
| 3,793,716 | 2/1974 | Smith-Johannsen | 29/611 |
| 4,223,209 | 9/1980 | Diaz | 219/549 |
| 4,307,290 | 12/1981 | Bloore et al. | 219/528 |
| 4,348,584 | 9/1982 | Gale et al. | 219/549 |
| 4,421,582 | 12/1983 | Horsma | 156/86 |

FOREIGN PATENT DOCUMENTS

| | | |
|---|---|---|
| 274965 | 10/1969 | Austria . |
| 313588 | 2/1974 | Austria . |
| 2157356 | 5/1973 | Fed. Rep. of Germany . |

*Primary Examiner*—Volodymyr Y. Mayewsky
*Attorney, Agent, or Firm*—Kurt Kelman

[57] ABSTRACT

A planar heating element having a positive temperature coefficient has a plurality of spaced electric current supply lines constituted by contact bands and a planar support, the electric current supply lines being operatively connected to the planar support, the contact bands and the support including an electrically conductive synthetic resin whose electrical resistance has a positive temperature coefficient.

7 Claims, 8 Drawing Figures

PLANAR HEATING ELEMENT

The present invention relates to a planar heating element having a positive temperature coefficient and comprising a plurality of spaced electric current supply lines, and more particularly to such a heating element useful for bandages or for heated blankets.

Published German Patent Application No. 2,157,356 discloses such heating elements for electrically heated blankets whose resistance increases with an increase in the temperature. The planar heating element is constituted by individual conductors which are independently incorporated into a blanket to form a mesh therein. To generate the desired temperatures, the conductors must have a relatively elevated temperature to radiate sufficient heat to the cold areas between the conductors to transmit the desired temperature over the entire area of the blanket. If the electric conductors are made of materials whose electrical resistance increases as the temperature rises, expensive switching devices, such as bimetallic switches or the like, may be saved. However, if the conductors are damaged, there remains the danger of short circuits and, since the conductors are quite hot, the blanket may be set afire. Furthermore, high voltages are required to generate the relatively high temperatures required in the conductors.

It is the primary object of this invention to provide a planar heating element capable of radiating heat uniformly over the entire area thereof while being constructed to avoid any danger of overheating of the element.

The above and other objects are accomplished according to the invention with a planar heating element whose electric current supply lines are constituted by contact bands and which comprises a planar support, the electric current supply lines being operatively connected to the planar support. The contact bands and support include an electrically conductive synthetic resin, preferably an elastomer, whose electrical resistance has a positive temperature coefficient.

This surprisingly simple structure provides the advantage of using a planar support which assures a uniform heat transmission practically over the entire area to be heated. Because the heat is radiated at the same time over a large area, it is possible to work with low voltages so that the temperatures of the heating element remain in a range in which the surrounding material, such as a bandage or a blanket, will not be set afire. Furthermore, a uniform coating of an electrically conductive synthetic resin whose electrical resistance has a positive temperature coefficient automatically limits the upper temperature. This limit applies not only to the capacity delivered to the contact bands but also to the environmental temperature which also influences the temperature of the planar heating element. This excludes any safety risk for the user and makes the heat application psychologically fully acceptable. It is of particular advantage that the planar heating element has a short wave length in the range of the black radiation. This conveys to the user of such a heating element in a blanket or bandage a sense of well-being. In addition, such black radiation has been found effective in the treatment of certain illness symptoms. Finally, planar heating elements constructed according to the present invention may be used without any temperature controls.

The above and other objects, advantages and features of this invention will become more apparent from the following detailed description of certain now preferred embodiments thereof, taken in conjunction with the generally schematic drawing wherein.

Electrically conductive resins useful for the planar heating element of the present invention include elastomers of the type disclosed in Austrian Pat. Nos. 274,965 and 313,588 whose disclosures are incorporated herein by way of reference. These are composition resistors made from synthetic resin dispersions or solutions or comminuted synthetic resins reacted with metal or metalloid compounds or their solutions, the reaction mixture containing about one metal or metalloid atom per synthetic resin molecule, a slight excess of a reducing agent being added to the reaction mixture, any remaining ions being washed out of the mixture and graphite or carbon black being added to the resultant dispersion, solution or granulate. The synthetic resin may be a polyamide, a polyester, such as an acrylic resin, a fluorocarbon resin, styrene or the like. The metal compound may be silver nitrate, nickel sulfate, ammonium molybdate or the like. The metalloid compound may be arsenic trioxide or arsine, for example. The reducing agent may be hydrazine, hydrazine hydrate or salts thereof, formaldehyde, dextrose, sodium hypophosphite. Such synthetic resins have a very positive temperature coefficient and the addition of the graphite or carbon black reduces their high specific resistance, the temperature coefficient of the synthetic resin prevailing as long as the conductive carbon particles are not in direct contact to from a conductive skeleton.

Figure 1:
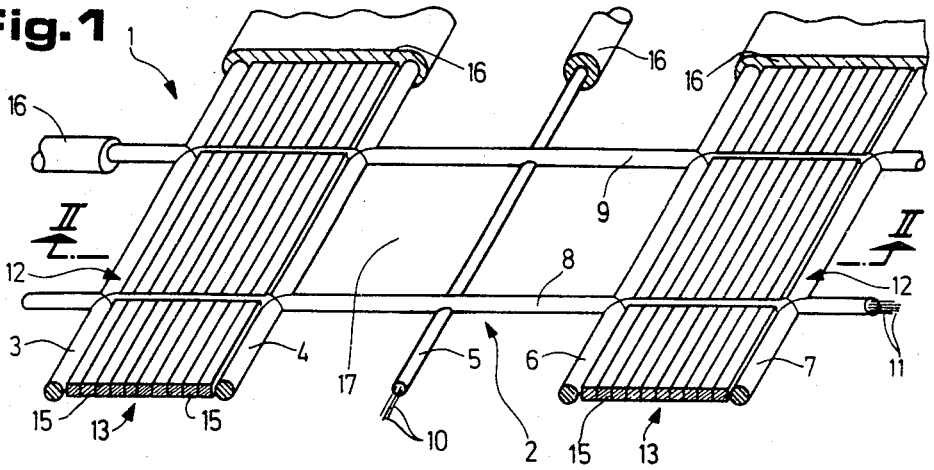
FIG. 1 is a perspective view of an embodiment of a planar heating element.

Referring now to the drawing and first to FIG. 1, there is shown planar heating element 1 having a positive temperature coefficient. The illustrated heating element comprises a plurality of spaced electric current supply lines 12 constituted by contact bands 13 and planar support 2, the electric current supply lines being operatively connected to the planar support. The contact bands and the support include an electrically conductive synthetic resin with a positive temperature coefficient of the electrical resistance, as described hereinabove. The synthetic resin is preferably an elastomer so that the entire structure is readily flexible.

With reference to the above-described synthetic resins, I have now discovered some surprising effects obtained with specific resins used in the planar heating element. If dispersions or solutions of finely dispersed synthetic resins or the solid resin in finely dispersed form are brought into contact with silver nitrate, individual silver ions adhere to the surface or recesses of macro-molecules of the resin. This adherence occurs even with the use of solid synthetic resin particles because of the surface roughness thereof, and experiments have shown that the silver ions apparently move into the molecular cavities. When the silver ions are subsequently reduced, the synthetic resin surprisingly shows semi-conductor properties. It has a relatively large specific resistance with a strongly positive temperature coefficient. As the silver content is increased, coherent silver coatings tend to be formed progressively whereby the temperature coefficient is increasingly displaced towards that of silver.

Additions of graphite and carbon black to increase the conductivity of a synthetic resin are known. In the synthetic resins used in the planar heating element of the invention, such additives are used to enhance the prevailing conductivity and to obtain a better removal of the heat when the synthetic resins are used as resistance material or as heating sheet. Therefore, the addition of graphite is merely an auxiliary measure. Since embedded conductive particles, such as graphite, need not be in contact with each other when a conductive synthetic resin is used, this composition is not only mechanically more resistant, but its conductivity is independent of any mechanical or thermal load. However, the electrical resistance may be oriented in a direction determined by a suitable orientation of the conductive particles.

The synthetic resins used in the planar heating element are free of ions because resins containing ions age rapidly when subjected to electric currents. Apparently, due to the effect of humidity, the ions may suddenly cause conduction to occur, thus destroying the effectiveness of the synthetic resin for the desired purpose.

With this in mind, it has been found that not only polymers such as polystyrene, polyvinyls, polyacrylic acid derivatives and mixed polymers of the same may be made electrically conductive, but also polyamides and their derivatives, polyfluorohydrocarbon, epoxy resins and polyurethane. It has been found that, in addition to the electrical conductivity, other properties of the polymers are also partially modified.

Following are specific examples of synthetic resins useful for the invention:

EXAMPLE 1

Fourteen hundred and seventy parts, by weight, of a 55 percent dispersion of a fluorohydrocarbon resin with 1 part, by weight, of a wetting agent
28 parts, by weight, of a 10 percent silver nitrate solution
6 parts, by weight, chalk
8 parts, by weight, ammonia
20 parts, by weight, carbon black
214 parts, by weight, graphite
11 parts, by weight, hydrazine hydrate

EXAMPLE 2

Thirteen hundred and eighty parts, by weight, of a 60 percent aqueous dispersion of an acrylic resin with 1 part, by weight, of a reducing agent
32 parts, by weight, of a 10 percent silver nitrate solution
10 parts, by weight, chalk
12 parts, by weight, ammonia
6 parts, by weight, carbon black
310 parts, by weight, graphite
14 parts, by weight, hydrazine hydrate

EXAMPLE 3

2200 parts, by weight, of distilled water
1000 parts, by weight, styrene monomer
600 parts, by weight, 15 percent amphol soap
2 parts, by weight, sodium pyrophosphate
2 parts, by weight, potassium persulphate
60 parts, by weight, nickel sulfate
60 parts, by weight, sodium hypophosphite
30 parts, by weight, adipinic acid
240 parts, by weight, graphite The polymerization proceeds under heat and the graphite is added after the polymerization of the styrene has been completed. After the resultant mixture has been granulated and dried, a sprayable conductive synthetic resin is obtained.

The illustrated planar support is a net and is at least partially comprised of the synthetic resin and filamentary carrier material is incorporated therein as reinforcement. In the embodiment of FIG. 1, filamentary carrier material 10, 11 of the net forms elongated resistors 3 to 7 and 8, 9 extending perpendicularly to each other, the filamentary carrier material consisting of polyamide or polyester filaments. Electric current supply lines 12 constituted by contact bands 13 are associated with some of the elongated resistors, i.e. with elongated resistors 3, 4 and 6, 7. The illustrated contact bands are comprised of flat wires each consisting of a multiplicity of parallel current conducting filaments 15 which may be comprised of carbon or metal filaments or fibers knitted or woven into a band. Electric current supply lines 12 are connected with elongated resistors 3, 4 and 6, 7, respectively.

This structure of the planar heating element enables the element to be manufactured at low cost since the filamentary carrier material and the synthetic resin net may be so formed that no further coating or application of contact bands is necessary. At the same time, the use of carbon filamentary material makes the support net resistant to mechanical wear, thus avoiding any possible damage to the contact bands. Furthermore, incorporating carbon filamentary material in the elastomer net has the added advantage that the contact bands will not be subject to corrosion when the heating element is used in a corrosive or otherwise chemically reactive environment. Where the support net comprises flexible filamentary carrier material and the contact bands are comprised of flexible flat wires, which are preferably arrayed parallel to the longitudinal direction of the filamentary net reinforcement, the heating element will readily conform to the user's body, for example in its use for heated bandages, so that the movements of the user or patient will not be unduly restricted. If the filamentary carrier material of the elongated resistors extending perpendicularly to the contact bands has a higher conductivity than that of the elongated resistors extending parallel thereto, no unwanted local overheating of the planar heating element can occur even if differences in the conductivity occur due to local overheating. Elongated resistors 3 to 7, which extend parallel to contact bands 13, may have a smaller cross section than elongated resistors 8 and 9 extending perpendicularly thereto. In this manner, the same material may be used for the manufacture of all the filamentary carrier material in the support net. If elongated resistors 8 and 9 extending perpendicularly to contact bands 13 as well as the elastomer applied thereto are elastic in the longitudinal direction of the resistance bands, changes in their length, due to different temperatures, may be readily compensated without causing internal stresses in the support net and its synthetic resin coating.

Referring to support net 2 of enlarged FIG. 1, the mesh size or distance between elongated resistors 3 to 9 is about 5 mm and contact bands 13 are usually spaced about 25 mm to 50 mm from each other, depending on the capacity of the planar heating element. To show the intersecting connections between the elongated resistor and the contact bands more clearly, elastomer coating 16 for the support net has been shown in FIG. 1 only along a short portion of the contact bands and resistors. Resistance bands 3 to 9 are so coated with the elastomer that meshes or openings 17 remain therebetween after the coating.

Elastomer 16 has a positive temperature coefficient of electrical resistance and consists essentially of a conductive silicon rubber whose resistance increases about 0.5–3% per K° for use of the heating element in heated bandages, heated blankets and the like.

The value of the resistance increase per degree K must be selected as a function of the heat absorption of the medium to be heated. In this respect, it must be taken into consideration that the initially uniform heat distribution becomes unstable at a certain limit temperature because a further small heating causes the increment in the power consumption to be greater than the increment in the heat transmission. This effect occurs particularly when the transmitted heat is substantially proportional to the temperature difference between the surface of the resistance and the ambient air, the resistance has a form which does not permit an internal heat exchange by heat conduction, such as a wire, film or the like, and consists of a material having a positive temperature coefficient of the electrical resistance. Therefore, care must be taken that planar heating element 1 does not have an unstable equilibrium since this would lead to a non-uniform heat distribution. In that case, the resistance would become much hotter at one point while it remains quite cool at another point. This would lead to overheating at the hot spots, causing the resistance to burn or melt.

In the following equations, L equals the power input, k equals heat transmission, t equals temperature differential between the surface of the heating element and the air, $R_o$ equals basic resistance (resistance of cold heating element) at 20 degrees cent., and c equals temperature coefficient. Assuming $L=k\cdot\Delta t$ and the electrical power consumption to be $L=I^2\cdot R_o$, temperature t will be $L=I^2\cdot R_o\cdot e^{c\Delta t}$.

t may then be computed by the equation $$k\cdot\Delta t=I^2\cdot R_o\cdot e^{c\Delta t}.$$

In the special case, this leads to a solution (tangent) up to which the temperature remains uniform:

$$k=e\cdot I^2\cdot R_o\cdot c$$

An unstable heat distribution is reached because the increment of the power consumption is greater than the increment in the heat transmission at a small amount of heating:

$$k\cdot\Delta t=I^2\cdot R_o\cdot e^{c\Delta t},\ \text{i.e. the limit temperature.}$$

$$\text{If } \frac{d}{d\cdot\Delta t}\cdot(k\cdot\Delta t)=\frac{d}{d\cdot\Delta t}\cdot I^2R_o\cdot e^{c\Delta t}$$

$$\text{then } k=I^2\cdot R_o\cdot c\cdot e^{c\cdot\Delta t}=I^2\cdot R_o e^{c\Delta t}\quad c=\frac{I}{\Delta t}$$

Therefore, $\Delta t=$U.c., i.e. at $c=0.05$, $\Delta t=20°$ C. Even at an excess temperature of 20° C., the unstable range will be theoretically if the temperature coefficient is 5%. However, since an internal heat exhange usually occurs in the film and I (the current intensity) is not constant, the limit temperature is higher in most instances.

In the embodiment of the invention wherein the conductivity of elongated resistors 8, 9 extending transversely to the current supply lines is higher than that of elongated resistors 3 to 7 running parallel thereto, a relatively small distance, may be maintained between electric current supply lines 12, causing an internal heat exchange to take place, which keeps the planar heating element in the range of a stable heat distribution.

Figure 2:
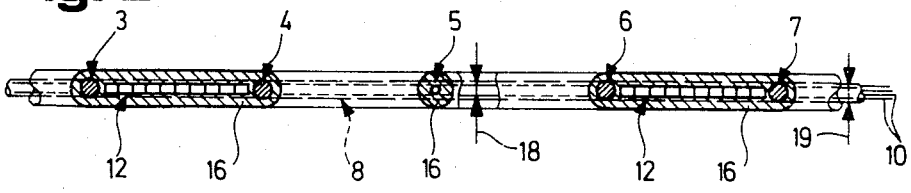
FIG. 2 is a sectional view along line II—II of FIG. 1.

The sectional view of FIG. 2 shows how elongated resistors 3 to 9 are coated with elastomer 16 which also coats electric current supply lines 12.

To assure a uniform heat transmission of planar heating element 1, cross section 18 of elongated resistors 3 to 7 running parallel to electric current supply line 12 is smaller than cross section 19 of elongated resistors 8, 9 running perpendicularly to the current supply lines. This safely avoids sparking from one current supply line 12 to the other current supply line 12.

Figure 3:
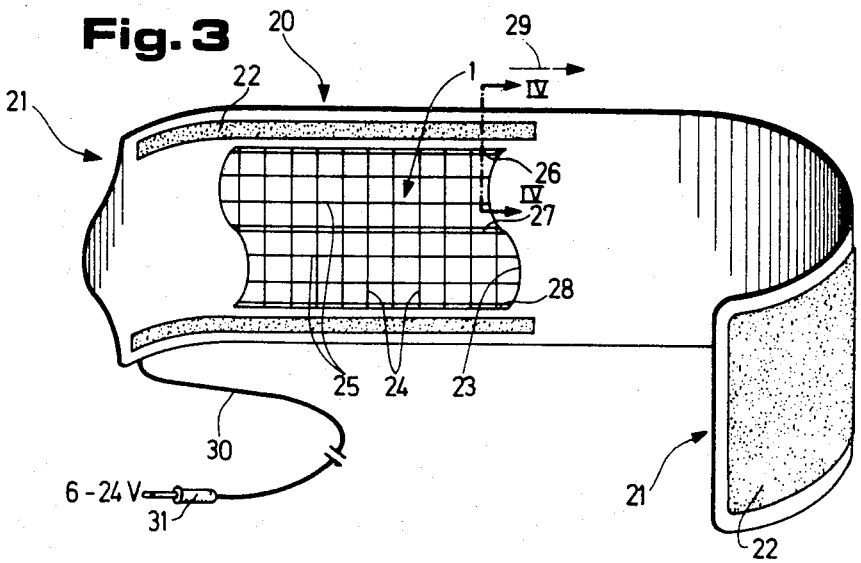
FIG. 3 is a perspective view illustrating a planar heating element in a safety bandage.

FIG. 3 illustrates planar heating element 1 incorporated into heated bandage 20. The heated bandage has the form of a belt whose end portions 21 carry hook-and-pile fastener surfaces 22, generally known under the trademark "Velcro". By pressing surfaces 22 together, end portions 21 are fastened together so that the heated bandage may be readily adjusted to different body measurements. Bandage 20 carries foam coating 23 a part of which has been removed to show elongated resistor 24, 25 an electric current supply lines 26 to 28 of the heating element. As shown, the current supply lines run in the longitudinal direction of the bandage, as indicated by arrow 29. A current supply source is connected to current supply lines 26 to 28 by transmission line 30 whose end carries plug contact 31. The current supply source preferably is a low-voltage source in the range of 6 to 42 V.

Figure 4:
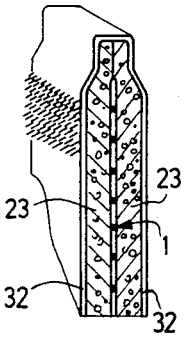
FIG. 4 shows the safety bandage in a sectional view along line IV—IV of FIG. 3.

FIG. 4 shows planar heating element 1 embedded between two layers of foam coating 23. Textile layer 32 is applied to the surfaces of the foam coatings. The edges of the foam coatings are pressed and bonded together so that the heating element is fully surrounded by the foam coatings on all sides.

If the support of planar heating element 1 has the form of a net, i.e. openings are provided between the elongated resistors of the heating element, and the form of coatings 23 is suitably selected, heated bandage 20 will have good vapor diffusion characteristics and enable the underlying skin to breathe. This will prevent perspiration under the bandage.

Figure 5:
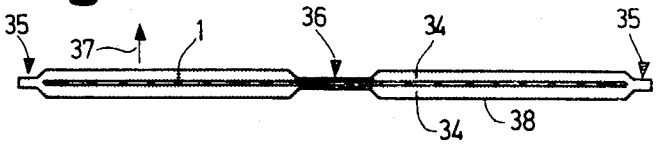
FIG. 5 is an end view, partly in section, of a heating pad incorporating the planar heating element with an associated reflecting layer.

FIG. 5 illustrates the application of planar heating element 1 to a heating pad. The heating element is surrounded on all sides by foam coating 34 to which a surface textile layer has been laminated. To position the heating element within foam coating 34, the foam layers are connected along edges 35 and center portion 36, for example by hit pressing. To increase the heat application in the main heat radiation direction indicated by arrow 37, the side of the heating pad opposite to this direction is provided by reflective layer 38. The reflective layer has small bores or holes to prevent it from interfering unduly with the vapor diffusion characteristics of the heating pad. Its major purpose is to prevent radiation of the heat energy in a direction opposite to the desired direction of the application of the heat, indicated by arrow 37.

The foam coating and surface textile layer laminated thereto will provide a cushioning effect if a person lies on the heating element. The use of the reflective layer will save energy.

Figure 6:
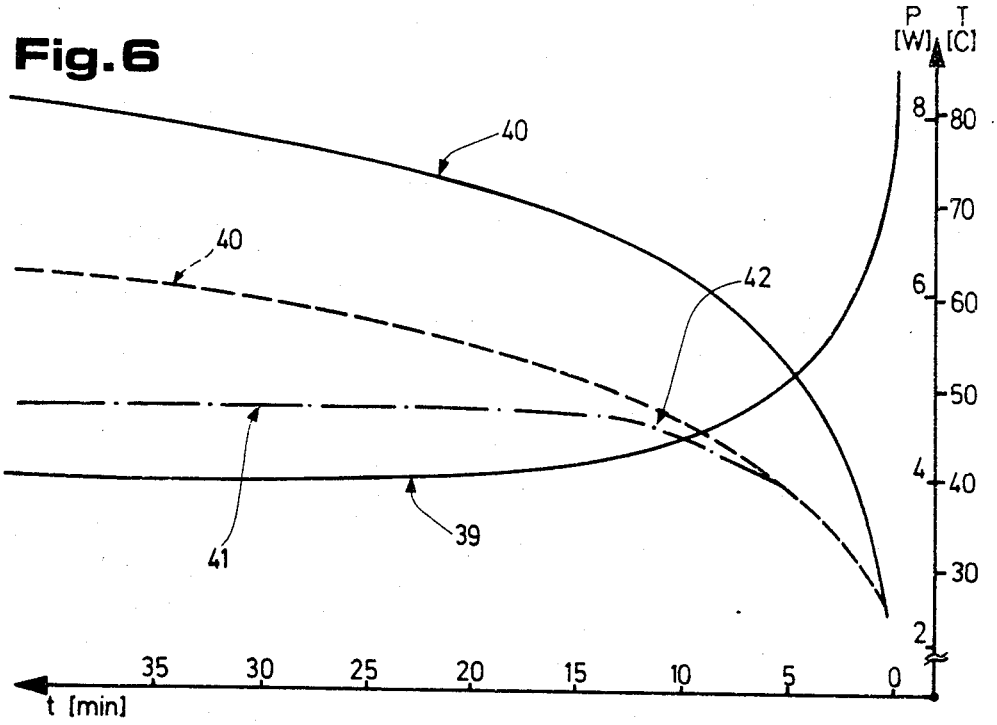
FIG. 6 is a diagram showing curves illustrating the power input of the planar heating element as well as its temperature in dependence on the duration.

The diagram of FIG. 6 illustrates the course of the energy absorption as a function of the time as well as the course of the temperature in comparison to the power consumption of heating element 1 of this invention.

As curve 39 shows, the power consumption of the heating element decreases with an increase in the heating time, which causes an increase in the temperature and a corresponding increase in the resistance of elastomer 16. This automatically stabilizes the planar heating element at a limit temperature, which is set by the nature of the elastomer used. Curve 40 shows the course of the temperature under ideal heat damping conditions in full lines while curve 40 in broken lines shows the temperature course of the heating element when it radiates heat, for example when it is used in a heating pad or a heated bandage. Temperature stabilization is reached at about 50° C.

Figure 7:
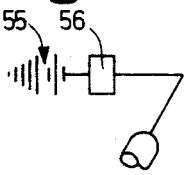
FIG. 7 is a perspective view of another embodiment.
Figure 7:
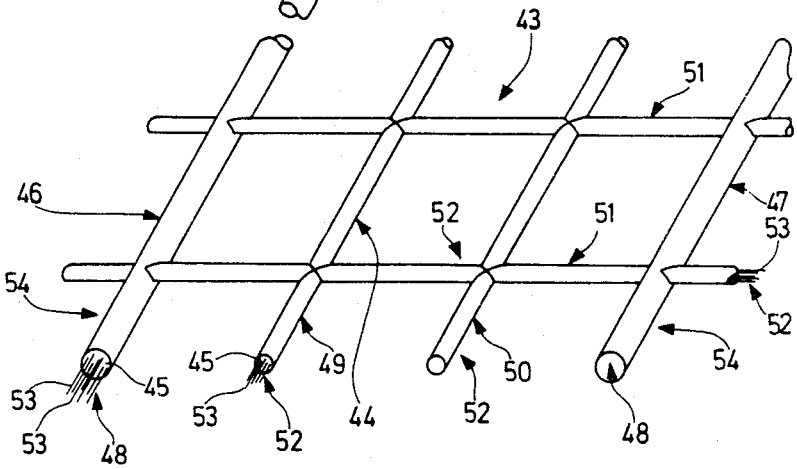

Dash-dotted curve 41 shows that the elastomer may have a non-linear temperature coefficient of electrical resistance with a distinct break 42 in the curve, at which temperature limit point the resistance increases suddenly. This occurs preferably in the range of the human body temperature. With this sudden increase in the resistance of the elastomer and the decrease in the power consumption, a relatively short heating period will rapidly produce a temperature stabilization in the heating element. This curve also shows the course of the temperature during the heat radiation of the planar heating element. This feature of the invention assures that the temperature of the heating element will not increase substantially above the body temperature since the sudden increase in the electrical resistance of the elastomer will automatically prevent further heating. Thus, overheating is dependably prevented FIG. 7 illustrates planar heating element 43 with planar support net 44. The basic material forming the net is at least partially comprised of electrically conductive elastomer 45. Net strands 46 and 47 constitute electric current supply lines 48 while net strands 49, 50, 51 constitute elongated resistors 52. To produce the difference in the conductivity according to the invention, filamentary carrier material 53, such as carbon and/or glass or metal filaments, is incorporated the net strands. If carbon filaments are used, they may serve not only as reinforcement of the net strands but also as electrical conductors. If glass filaments are used, optionally in combination with carbon filaments, metal filaments, for example of copper or similar good conductors, are added to increase the conductivity. The desired difference in the conductivity is obtained by using different numbers of filaments in filamentary carrier material 53 incorporated, respectively, in net strands 46, 47 and 49 to 51. To obtain the conductivity in net strands 49, 50 running parallel to net strands 46, 47 according to the present invention, fewer filaments are embedded in net strands 49, 50 than in net strands 51 running transversely thereto.

It is within the scope of this invention to knit the filamentary carrier material, for example carbon filaments optionally mixed with glass filaments or metal filaments, to form the net and to coat the knitted net with elastomer 45 with a layer of even thickness. On the other hand, the different conductivities of the individual net strands may be obtained by different thicknesses of the elastomer coatings.

As also shown schematically in FIG. 7, contact bands 54 constituted by filamentary carrier material 53 forming electric supply lines are connected to low-voltage electric current source 55. Cascade connection 56 connects the electric current source to the contact bands for half-wave operation with a semi-conductive diode. The use of a low-voltage source for supplying power to the planar heating element of this invention enables the same to be used universally also for such application where safety precautions prevented the use of such heating elements because of their requirement for a high-voltage power supply.

While the planar heating element has been specifically described and illustrated embedded in a foam coating to which a textile surface layer is laminated, if desired, other receptacles for the heating element may chosen, such as pure textile covers or covers consisting of other types of synthetic resin sheets. The energy supply and control for providing electric power to the heating element also may be selected according to any requirement. Also, to increase the operational safety, overheating of the heating element may be excluded not only by the selection of a suitable synthetic resin covering for the heating element but also by providing a thermo-sensitive switch for interrupting the power supply in case of overheating.

The use of a synthetic resin support net for the heating element, which is coated with, or consists of, electrically conductive, jet-black polymers, has a number of advantages. Because such a coating or composition provides a semiconductor system for the electric current supply, it automatically regulates the current flow in dependence on the temperature. The higher the temperature, the lower the current intensity until it becomes immeasurably small when a certain thermal equilibrium has been reached. This self-regulation makes any burning of the conductors due to overheating just about impossible. When the planar heating element of this invention is used in a heated bandage, it has the medical advantage that the emission capacity of a body having the temperature T for radiating wavelength $\lambda$ is equal to its absorption capacity for this radiation. Since the support net is constituted by a black body and, therefore, has the greatest possible absorption capacity, such a black body can also emit radiations of all wavelengths. According to Wien's displacement law, the wavelength of the most intensive radiation $\lambda_{maximum}$ is inversely proportional to the temperature, the intensity of the radiated wavelength increases with a decrease in the temperature. Thus, the radiation is displaced more and more towards the invisible infrared (heat radiation). Since the temperature of the heated bandage is about 300° K and the heat source can be considered as a substantially black body, the essential spectral range of the emitted radiation lies in the infrared spectrum. The infrared radiation penetrates the body more deeply than visible light and, even at lower temperatures, a feeling of warmth will be sensed equal to that occurring at higher temperatures in other spectral ranges of radiation. The deeper penetration of the infrared radiation and the stronger resonance of the biochemical macromolecules due to the longer wavelength of the radiation is the cause of the physiological effects preventing, for example, reddening of the skin after extended use of the heated bandage and a feeling of considerable warmth experienced by the user. The normally occurring heat dam at the skin is not encountered with a heated bandage using the heating element of the invention.

Figure 8:
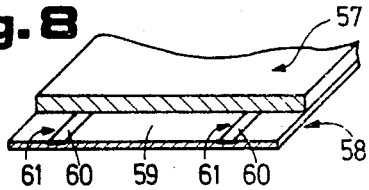
FIG. 8 is a fragmentary perspective view of yet another embodiment.

In the embodiment of FIG. 8, planar heating element 57 has planar support 58 comprised of synthetic resin web 59. Contact bands 60 are applied to this support mat or are incorporated therein. If the synthetic resin web is woven, the contact bands may be woven into it. The contact bands form electric current supply lines 61 and may consist of a filamentary carrier material, such as silver-coated carbon filaments, copper filaments or flat wires of silver-coated carbon or of copper. Electrically conductive synthetic resin with a positive temperature coefficient of electrical resistance is applied to planar support 58 and the web portions between contact bands 60 serve as elongated resistors, together with the synthetic resin applied to these portions, which is heated when electric current is supplied to the contact bands. Because of the positive temperature coefficient of the synthetic resin, the temperature rapidly rises when full power is supplied, which increases the resistance of the synthetic resin, decreasing the power and creating a temperature stabilization. Only so much energy is then supplied to heating element 57 as is radiated by the heating element so that the temperature remains stable. Web 59 of planar support 58 is so formed that the filaments extending perpendicular to contact bands 60 have a higher conductivity than the filaments parallel to the contact bands.

It will be apparent from the above description that the planar support may take any form or shape adapted to a specific field of application. For instance, elongated bands may be used, as well as plates or shaped bodies of various types and peripheries.

What is claimed is:

1. A planar heating element having a positive temperature coefficient, which comprises a plurality of spaced electric current supply lines and a planar support equally flexible in all direction and constituted by a net, the electric current supply lines forming strands of the planar net support, and all the net strands including an electrically conductive synthetic resin whose electrical resistance has a positive temperature coefficient.

2. The planar heating element of claim 1, wherein the synthetic resin is an elastomer.

3. The planar heating element of claim 1, wherein the support is at least partially comprised of the synthetic resin and a filamentary carrier material is incorporated therein.

4. The planar heating element of claim 3, wherein the filamentary carrier material constitutes the electrical supply lines.

5. The planar heating element of claim 4, wherein the filamentary carrier material comprises electrically conductive filaments selected from the group consisting of carbon and metal filaments.

6. The planar heating element of claim 1, further comprising a low-voltage electric current source and the electrically conductive synthetic resin is adapted to connect the electric current supply to the electric current source.

7. The planar heating element of claim 6, wherein the electric current source comprises a cascade connection for half-wave operation with a semi-conductive diode.

* * * * *